United States Patent [19]

Zulawski

[11] Patent Number: 5,016,728

[45] Date of Patent: May 21, 1991

[54] AIR INTAKE NOISE SUPPRESSOR

[75] Inventor: Dennis P. Zulawski, St. Hilaire, Minn.

[73] Assignee: Arctco, Inc., Thief River Falls, Minn.

[21] Appl. No.: 491,514

[22] Filed: Mar. 12, 1990

[51] Int. Cl.[5] ..... F02M 35/00

[52] U.S. Cl. ..... 181/229; 181/255

[58] Field of Search ..... 181/229, 258, 255

[56] References Cited

U.S. PATENT DOCUMENTS

| | | | |
|---|---|---|---|
| 3,835,956 | 9/1974 | Kishira | 181/229 |
| 4,093,039 | 6/1978 | Moore et al. | 181/229 |
| 4,109,751 | 8/1979 | Kabele | 181/229 X |
| 4,136,756 | 1/1979 | Kawamura | 181/229 |
| 4,782,912 | 11/1988 | Wandless | 181/229 |

*Primary Examiner*—Brian W. Brown

*Attorney, Agent, or Firm*—Jerold M. Forsberg; James E. Olds

[57] ABSTRACT

An air intake noise suppressor for a snowmobile engine disposed on the intake side of a carburetor has an enclosure with a front face having apertures therein connected to the carburetor and a rear face canted relative to the front face. The rear face has an integrally formed frustoconical extension for permitting air to flow into the enclosure. The frustoconical extension extends into the enclosure and the enclosure has a irregular bottom wall providing additional reflective surfaces inside the enclosure. Sound emanating from the carburetor enters the enclosure through the apertures and is reflected and entrapped therein unit it is attenuated. The small amount of sound that may escape the enclosure through the frustoconical extension is either attenuated in a juxtaposed enclosure formed by a shroud or directed through louvers down and away to either side of the driver.

15 Claims, 2 Drawing Sheets

FIG. 1
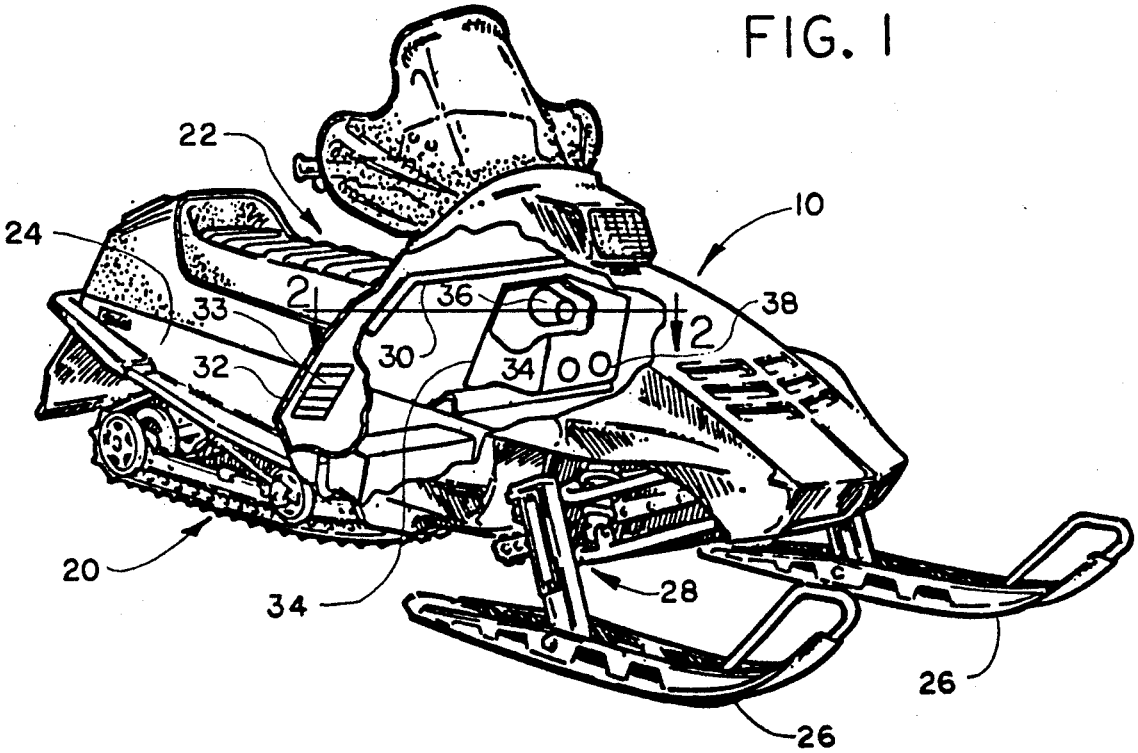
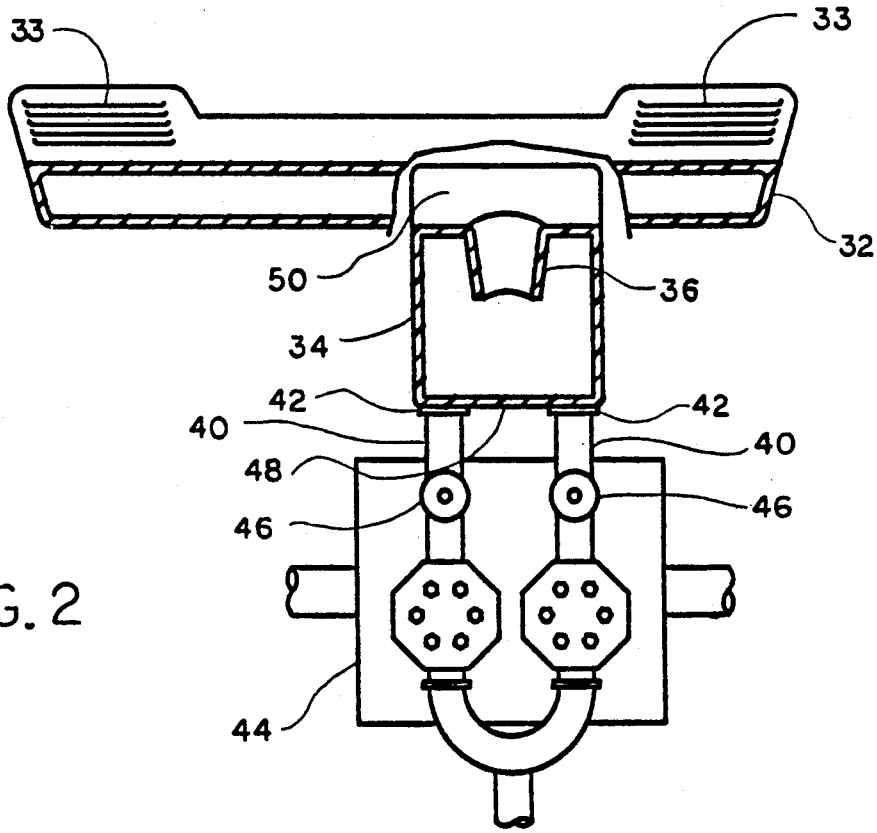
FIG. 2

AIR INTAKE NOISE SUPPRESSOR

BACKGROUND OF THE INVENTION

The present invention relates generally to an air intake noise suppressor, and more specifically to a noise suppressing enclosure which is disposed upstream in the flow of air to the carburetor on a snowmobile engine.

Snowmobiles have typically been rather noisy pieces of equipment for the user because of the arrangement of the component parts. The fact that the engine is mounted directly in front of the driver has presented a number of unique problems including the protection of the driver from excessive noise. Advancements have been made in reducing the overall noise level of a snowmobile under operating conditions. However, one form of noise which has proved to be difficult to attenuate is the noise coming back out of the air intake of a carburetor. One prior art device, depicted in U.S. Pat. No. 4,093,039, shows an air intake silencer box which is universal in nature and includes provisions for adding divider walls and relies upon air being admitted to the box by way of tubular member 44. Another prior art arrangement for a snowmobile, as depicted in U.S. Pat. No. 3,810,518, shows a snowmobile hood which includes an air supply chamber 37 for directing air into the carburetor of the engine. Another prior art device, seen in U.S. Pat. No. 4,109,751, shows an arrangement of a housing subdivided by a wall and utilizing a tube arrangement to trap sound coming back from the carburetor within the housing. Finally, a combined engine, air cleaner, and noise reducer, depicted in U.S. Pat. No. 4,782,912, shows an air inlet tube 14 with a generally cone shaped insert 20 disposed within the inlet tube for enhancing the flow of air to the engine in addition to controlling the passage of sound returning from the engine air intake.

None of the prior art arrangements disclose or suggest the particular arrangement of the instant invention.

SUMMARY OF THE INVENTION

The present invention provides a novel air intake noise suppressor which is effective on low frequency as well as on high frequency noise.

In accordance with the present invention, an enclosure is provided upstream in the flow of air to the intake of the carburetor. The enclosure is constructed in a manner such that noise emanating from the intake of the carburator back into the enclosure is entrapped therein with most if not all of the noise being attenuated. The enclosure includes a front face and a rear face which is canted relative to the front face with the rear face having a frustoconical air inlet extending into the interior of the enclosure. The front face includes one or more apertures through which air passes from the interior of the enclosure to the inlet of the carburetors. The apertures each have a central axis and the apertures are disposed in the front face such that the axis of each of the apertures does not intersect a central axis of the frustoconical air inlet. The enclosure also includes an irregularly extending bottom wall which forms additional angled reflective surfaces on the interior of the enclosure such that sound coming into the enclosure from the carburetor is reflected around inside of the chamber until it is attenuated. Little if any of the sound finds its way back through the frustoconical air inlet because of the reduced opening size as well as the extention of the frustoconical inlet into the interior of the enclosure.

Ideally, the enclosure is of a molded plastic material and is formed in two parts with the two parts being attached to one another by plastic welding. It has been found that prior to the attachment of the two portions to one another, there can be some modification of the enclosure when the enclosure is to be used with engines having carburetors of different sizes. The modifications can typically include the enlargement of the outlet apertures and the enlargement of the frustoconical inlet by the trimming of the end of the frustoconical extention such that the size of the end of the extention is larger.

Accordingly, it is an object of the present invention to provide a new and useful air intake noise suppressor which will substantially reduce and under certain conditions eliminate the low frequency noise in the range of 100 to 600 Hz emanating from the carburetor inlet on an engine.

Other objects and advantages of the present invention will be apparent and understood from the following detailed description when taken in conjunction with the accompanying drawings.

BRIEF DESCRIPTION OF THE DRAWINGS

An air intake noise suppressor for a snowmobile engine constructed in accordance with this invention is described hereinbelow with reference to the accompanying drawing, wherein:

FIG. 1 is a perspective view with a portion of the snowmobile hood broken away to show the relative location of the air intake noise suppressor with a portion of the enclosure of the suppressor broken away to show the interior;

FIG. 2 is a cross-sectional view taken in the direction of arrows 2—2 in FIG. 1, included in this view is a representation of the snowmobile engine;

DETAILED DESCRIPTION OF THE PREFERRED EMBODIMENT

Figure 3:
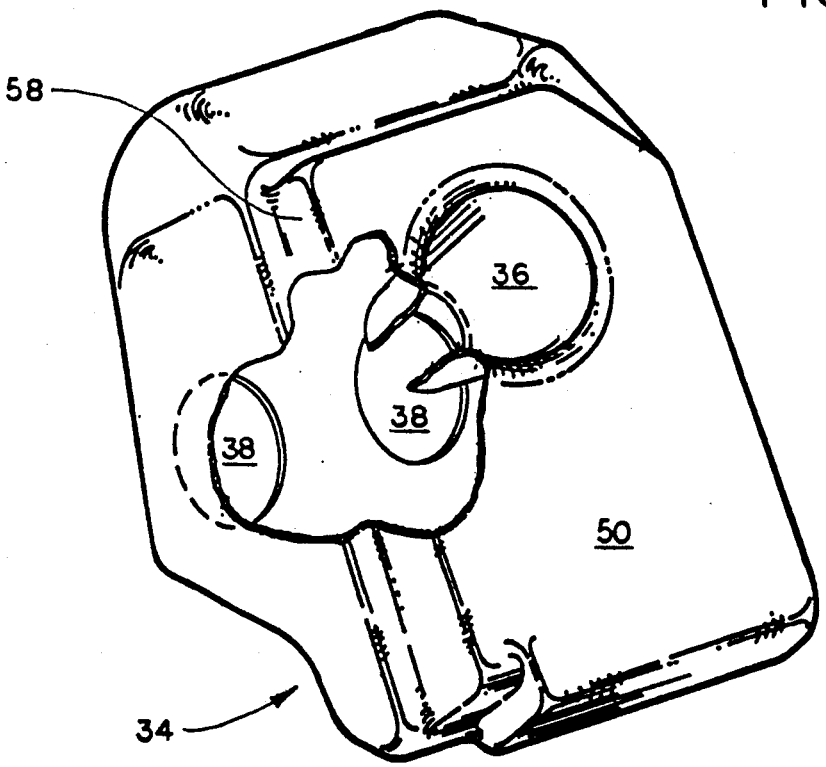
FIG. 3 is a perspective view of the air intake noise suppressor in accordance with the instant invention.

It should be noted that like reference numerals are used throughout the various views to designate similar elements or components.

Referring now to FIG. 1, a snowmobile 10 of the type having a forwardly mounted engine (not shown in this figure) is depicted as having a traction unit 20, a seat area 22, a chassis 24, steerable skis 26, and a steering and suspension linkage arrangement 28 interconnecting the skis to the chassis.

Chassis 24 includes a tubular frame 30 to which a shroud 32 is attached. Shroud 32 generally faces the seat area 22 and forms an enclosure to which access is provided by air inlet louvers 33. Louvers 33 are laterally disposed relative to the seat area 22, the reasons for which will be discussed later. An air intake noise suppressor having an enclosure 34 constructed in accordance with the instant inventions is mounted juxtaposed and is in direct communication with the enclosure formed by shroud 32.

Figure 4:
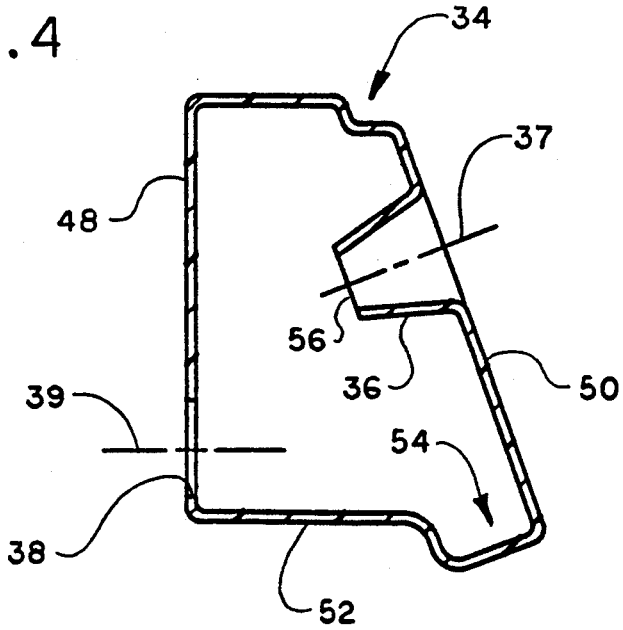
FIG. 4 is a cross-sectional view taken through the frustoconical inlet and one of the outlet apertures of the enclosure as seen in FIG. 3.

As best seen in FIGS. 3 and 4, enclosure 34 includes a frustoconical extension 36, i.e., a truncated cone, having a central axis 37 about which the frustoconical extension 36 is symmetrical and outlet apertures 38 having an axis 39. Apertures 38 are attached by soft flexible rubber tubes 40 by way of flanges 42 on the tubes to carburetors 46 on engine 44. Flanges 42 include an annular groove (not shown) for attaching tubes 40 to the outlet apertures 38. Enclosure 34 includes a front face 48 in which the outlet apertures are formed, a rear face 50 which is canted relative to front face 48, and an irregular bottom wall 52 which forms an area 54 providing additional reflective surfaces within the enclosure. Frustoconical extension 36 is integrally formed with rear face 50 such that a base of the frustoconical extension terminates in rear face 50 and is flush therewith. The frustoconical extension 36 extends into the interior of enclosure 34, terminates at an outlet end 56, and is disposed such that central axis 37 is substantially perpendicular to rear face 50. As best seen in FIG. 3, enclosure 34 includes a molded recess 58 which cooperates with tubular frame 30 for mounting the enclosure 34 relative to chassis 24.

Enclosure 34 is disposed upstream of the flow of air to the intake of carburetors 46 and, as has been discussed, is connected to the carburetors by tubes 40 and is in direct communication with the enclosure formed by shroud 32 which has air inlet louvers 33 opening on either side of the seat area 22. The only way into enclosure 34 from the enclosure formed by shroud 32 is through outlet end 56 of frustoconical extension 36 and likewise the only way out of enclosure 34 and into the enclosure formed by shroud 32 is through the same outlet end 56 of frustoconical extension 36. Accordingly, while air is free to flow in the direction toward the carburetors, sound, i.e., noise, emanating from the carburetors 46 and entering enclosure 34, generally in the direction of the extension of axis 39, is reflected within enclosure 34 many times with most of the noise being attenuated by being trapped within the enclosure. The effectiveness of the device is due to the positioning of outlet end 56 within enclosure 34, the irregular shape of the enclosure, and the fact that the noise entering along axis 39 will not directly impinge on outlet end 56 along with the fact that noise will be reflected many times within the enclosure. The small amount of noise that may escape from enclosure 34 can only escape if it is reflected within the enclosure 34 in a manner such that it is able to pass through outlet end 56, whereupon, the escaped noise must then find its way to louvers 33 in order to escape from the enclosure formed by shroud 32. Clearly, any noise escaping from louvers 33 will be minimal and, due to the positioning of louvers 33, directed downwardly and away from the driver.

Enclosure 34 is ideally manufactured of a moldable plastic in two parts which are then joined together by plastic welding. It has been found that modification of the size of apertures 38 and the size of the outlet end 56 of frustoconical extension 36 may be made if necessary and that changes are easily made prior to the joining of the two parts together. The easiest method of modification is by simply cutting the apertures larger and the trimming off of the end 56.

While the air intake noise suppressor of this invention has been found to be particularly effective in attenuating sound emanating from the carburetors, it is the attenuation of the low frequency sound between the ranges of 100 and 600 Hz which was a particular desired result. Again, while it is believed that most of the sound coming back from the carburetor is attenuated within the enclosure 34, any sound which may escape through frustoconical extension 36 then enters the chamber 32 formed by the shroud and, if the sound is then able to pass through this chamber, it is directed out through louvers 33, which are laterally disposed relative to 22 seat area downwardly and away from the driver.

Of importance to note is that an enclosure in accordance with the instant invention is easily removed from purposes such as the carburetors for purposes such as making adjustments thereto.

It should be understood that other forms of the air intake noise suppressor are contemplated by the present invention and that numerous modifications may be made by those of skill in the art without departing from the scope and spirit of the invention.

I claim:

1. An air intake noise suppressor for attenuating noise from carburetors of a snowmobile engine, the suppressor comprising an irregularly shaped enclosure having a front face and a rear face canted relative to the front face, a truncated conical inlet integral with the rear face extending into the enclosure from the rear face, and outlet apertures for connection to carburetors in the front face, whereby noise emanating from the carburetors and entering the enclosure through the outlet apertures does not directly impinge on an open end of the truncated cone and is reflected within the enclosure.

2. An air intake noise suppressor according to claim 1 further comprising a soft rubber tube having a flange on one end for connecting the outlet apertures of the enclosure to the carburetors.

3. An air intake noise suppressor according to claim 1, wherein the enclosure is fabricated of moldable plastic and manufactured in two separate halves which are joined by means of plastic welding.

4. An air intake noise suppressor for attenuating noise from carburetors, the suppressor comprising an irregularly shaped enclosure having a front face and a rear face canted relative to the front face, a frustoconical air inlet with a central axis extending into the enclosure from the rear face, and an outlet aperture for connection to a carburetor in the front face, the outlet aperture having a central axis and being disposed in the front face such the axis of the air inlet does not intersect the axis of the outlet aperture within the enclosure, whereby noise from the carburetors entering the enclosure through the outlet aperture is reflected with most of the noise being attenuated within the enclosure.

5. An air intake noise suppressor according to claim 4, wherein the frustoconical air inlet is integrally formed with the rear face such that all of the frustoconical air inlet is within the enclosure.

6. An air intake noise suppressor according to claim 4, wherein a bottom wall of the enclosure is irregular thereby providing reflective inner surfaces which do not directly reflect noise entering through the outlet aperture along the axis of the frustoconical air inlet.

7. An air intake noise suppressor according to claim 6, wherein the enclosure is fabricated of moldable plastic and manufactured in two separate halves which are joined by means of plastic welding.

8. An air intake noise suppressor according to claim 7, wherein the enclosure includes a molded recess for positioning and mounting the enclosure to supporting structure.

9. An air intake noise suppressor according to claim 6, wherein a flexible tube connects the outlet aperture with an inlet on a carburetor, the tube directing noise emanating from the carburetor into the enclosure in outlet aperture while permitting the free flow of air needed by the carburetor.

10. An air intake noise suppressor for attenuating noise from a carburetor mounted to an engine of a snowmobile, the suppressor comprising an irregularly shaped enclosure having a front face and a rear face canted relative to the front face, a frustoconical air inlet with a central axis extending into the enclosure from the rear face, and an outlet aperture for connection to a carburetor in the front face, the outlet aperture having a central axis and being disposed in the front face such the axis of the air inlet does not intersect the axis of the outlet aperture within the enclosure, the enclosure including means for facilitating attachment of the enclosure to a snowmobile chassis, whereby noise from the carburetor entering the enclosure through the outlet aperture is reflected with most of the noise being attenuated within the enclosure therein.

11. An air intake noise suppressor for a snowmobile engine according to claim 10, wherein the frustoconical air inlet is integrally formed with the rear face such that all of the frustoconical air inlet is within the enclosure.

12. An air intake noise suppressor according to claim 11, wherein the enclosure is fabricated of moldable plastic and manufactured in two separate halves which are joined by means of plastic welding.

13. An air intake noise suppressor according to claim 12, wherein the enclosure includes a molded recess for positioning and mounting the enclosure relative to a tubular frame on the snowmobile chassis.

14. An air intake noise suppressor according to claim 13, wherein a flexible tube connects the outlet aperture with an inlet on the carburetor, the tube directing noise emanating from the carburetor into the enclosure central axis of the while permitting a free flow of air needed by the carburetor.

15. An air intake noise suppressor according to claim 13, wherein the snowmobile chassis includes a shroud with a pair of air inlet louvers therein, the shroud being attached to the tubular frame with the louvers disposed laterally of a seat area on the snowmobile, the frustoconical air inlet of the enclosure being in open communication with an enclosure formed by the shroud through which air passes to the carburetors.

* * * * *